US005690301A

United States Patent [19]

Shelton et al.

[11] Patent Number: 5,690,301

[45] Date of Patent: Nov. 25, 1997

[54] STUD MOUNTED REEL SUPPORT SYSTEM

[76] Inventors: Ron Shelton, 810 Spruce Hill La., Ortonville, Mich. 48462; Max Van Keuren, 7972 Perry Lake Rd., Clarkston, Mich. 48348

[21] Appl. No.: 689,725

[22] Filed: Aug. 12, 1996

[51] Int. Cl.[6] ..... B65H 75/18; B65H 49/00; B65H 49/18

[52] U.S. Cl. ..... 242/597.8; 242/129; 242/139

[58] Field of Search ..... 242/129, 139, 242/597.4, 597.8, 597; 248/246, 217.3, 300, 309.2

[56] References Cited

U.S. PATENT DOCUMENTS

| | | | |
|---|---|---|---|
| 2,241,891 | 5/1941 | Sollie | 242/139 X |
| 2,727,702 | 12/1955 | Latincich | 242/597.4 X |
| 3,319,906 | 5/1967 | Atkinson | 242/597.8 X |
| 3,837,597 | 9/1974 | Bourhenne | 242/129 |
| 4,167,255 | 9/1979 | Benson | 242/129 |
| 4,214,718 | 7/1980 | Silkey | 242/129.6 |
| 4,856,729 | 8/1989 | Maraman | 242/129 |
| 5,348,241 | 9/1994 | Huette | 242/129 X |

*Primary Examiner*—Michael Mansen

[57] ABSTRACT

A Stud Mounted Reel Support System for facilitating efficient spooling of wire from a wire spool by removably attaching to a conventional stud without a fastener inserted thereby elevating the wire spool off of the floor increasing the workable surface area of the floor. The inventive device includes an upper cuff secured around the rear edge of the conventional stud, a connecting bar secured at one end to the upper cuff, a lower cuff secured around the front edge of the conventional stud and secured to the end of the connecting bar opposite of the upper cuff thereby firmly gripping the conventional stud, a horizontal cantilever arm secured at one end to the lower cuff and where a wire reel rotatably surrounds the horizontal cantilever arm, and a flange at the tip of the horizontal cantilever arm thereby retaining the wire reel in position during rotation.

9 Claims, 3 Drawing Sheets

STUD MOUNTED REEL SUPPORT SYSTEM

BACKGROUND OF THE INVENTION

1. Field of the Invention

The present invention relates to Spooling Devices and more particularly pertains to a new Stud Mounted Reel Support System for facilitating efficient spooling of wire from a wire spool by removably attaching to a conventional stud without a fastener inserted thereby elevating the wire spool off of the floor increasing the workable surface area of the floor.

2. Description of the Prior Art

The use of Spooling Devices is known in the prior art. More specifically, Spooling Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Spooling Devices include U.S. Pat. No. 4,752,047; U.S. Pat. No. 4,214,718; U.S. Design Pat. No. 345,857; U.S. Pat. No. 5,348,241; U.S. Pat. No. 4,132,372 and U.S. Pat. No. 4,856,729.

While these devices fulfill their respective, particular objectives and requirements, the aforementioned patents do not disclose a new Stud Mounted Reel Support System. The inventive device includes an upper cuff secured around the rear edge of the conventional stud, a connecting bar secured at one end to the upper cuff, a lower cuff secured around the front edge of the conventional stud and secured to the end of the connecting bar opposite of the upper cuff thereby firmly gripping the conventional stud, a horizontal cantilever arm secured at one end to the lower cuff and where a wire reel rotatably surrounds the horizontal cantilever arm, and a flange at the tip of the horizontal cantilever arm thereby retaining the wire reel in position during rotation.

In these respects, the Stud Mounted Reel Support System according to the present invention substantially departs from the conventional concepts and designs of the prior art, and in so doing provides an apparatus primarily developed for the purpose of facilitating efficient spooling of wire from a wire spool by removably attaching to a conventional stud without a fastener inserted thereby elevating the wire spool off of the floor increasing the workable surface area of the floor.

SUMMARY OF THE INVENTION

In view of the foregoing disadvantages inherent in the known types of Spooling Devices now present in the prior art, the present invention provides a new Stud Mounted Reel Support System construction wherein the same can be utilized for facilitating efficient spooling of wire from a wire spool by removably attaching to a conventional stud without a fastener inserted thereby elevating the wire spool off of the floor increasing the workable surface area of the floor.

The general purpose of the present invention, which will be described subsequently in greater detail, is to provide a new Stud Mounted Reel Support System apparatus and method which has many of the advantages of the Spooling Devices mentioned heretofore and many novel features that result in a new Stud Mounted Reel Support System which is not anticipated, rendered obvious, suggested, or even implied by any of the prior art Spooling Devices, either alone or in any combination thereof.

To attain this, the present invention generally comprises an upper cuff secured around the rear edge of the conventional stud, a connecting bar secured at one end to the upper cuff, a lower cuff secured around the front edge of the conventional stud and secured to the end of the connecting bar opposite of the upper cuff thereby firmly gripping the conventional stud, a horizontal cantilever arm secured at one end to the lower cuff and where a wire reel rotatably surrounds the horizontal cantilever arm, and a flange at the tip of the horizontal cantilever arm thereby retaining the wire reel in position during rotation.

There has thus been outlined, rather broadly, the more important features of the invention in order that the detailed description thereof that follows may be better understood, and in order that the present contribution to the art may be better appreciated. Them are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Stud Mounted Reel Support System apparatus and method which has many of the advantages of the Spooling Devices mentioned heretofore and many novel features that result in a new Stud Mounted Reel Support System which is not anticipated, rendered obvious, suggested, or even implied by any of the prior art Spooling Devices, either alone or in any combination thereof.

It is another object of the present invention to provide a new Stud Mounted Reel Support System which may be easily and efficiently manufactured and marketed.

It is a further object of the present invention to provide a new Stud Mounted Reel Support System which is of a durable and reliable construction.

An even further object of the present invention is to provide a new Stud Mounted Reel Support System which is susceptible of a low cost of manufacture with regard to both materials and labor, and which accordingly is then susceptible of low prices of sale to the consuming public, thereby making such Stud Mounted Reel Support System economically available to the buying public.

Still yet another object of the present invention is to provide a new Stud Mounted Reel Support System which provides in the apparatuses and methods of the prior art some of the advantages thereof, while simultaneously overcoming some of the disadvantages normally associated therewith.

Still another object of the present invention is to provide a new Stud Mounted Reel Support System for facilitating efficient spooling of wire from a wire spool by removably attaching to a conventional stud without a fastener inserted thereby elevating the wire spool off of the floor increasing the workable surface area of the floor.

Yet another object of the present invention is to provide a new Stud Mounted Reel Support System which includes an upper cuff secured around the rear edge of the conventional stud, a connecting bar secured at one end to the upper cuff, a lower cuff secured around the front edge of the conventional stud and secured to the end of the connecting bar opposite of the upper cuff thereby firmly gripping the conventional stud, a horizontal cantilever arm secured at one end to the lower cuff and where a wire reel rotatably surrounds the horizontal cantilever arm, and a flange at the tip of the horizontal cantilever arm thereby retaining the wire reel in position during rotation.

Still yet another object of the present invention is to provide a new Stud Mounted Reel Support System that is simple and easy to use and relocate without utilizing nails or screws.

Even still another object of the present invention is to provide a new Stud Mounted Reel Support System that does not take up valuable floor space like comparable inventions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
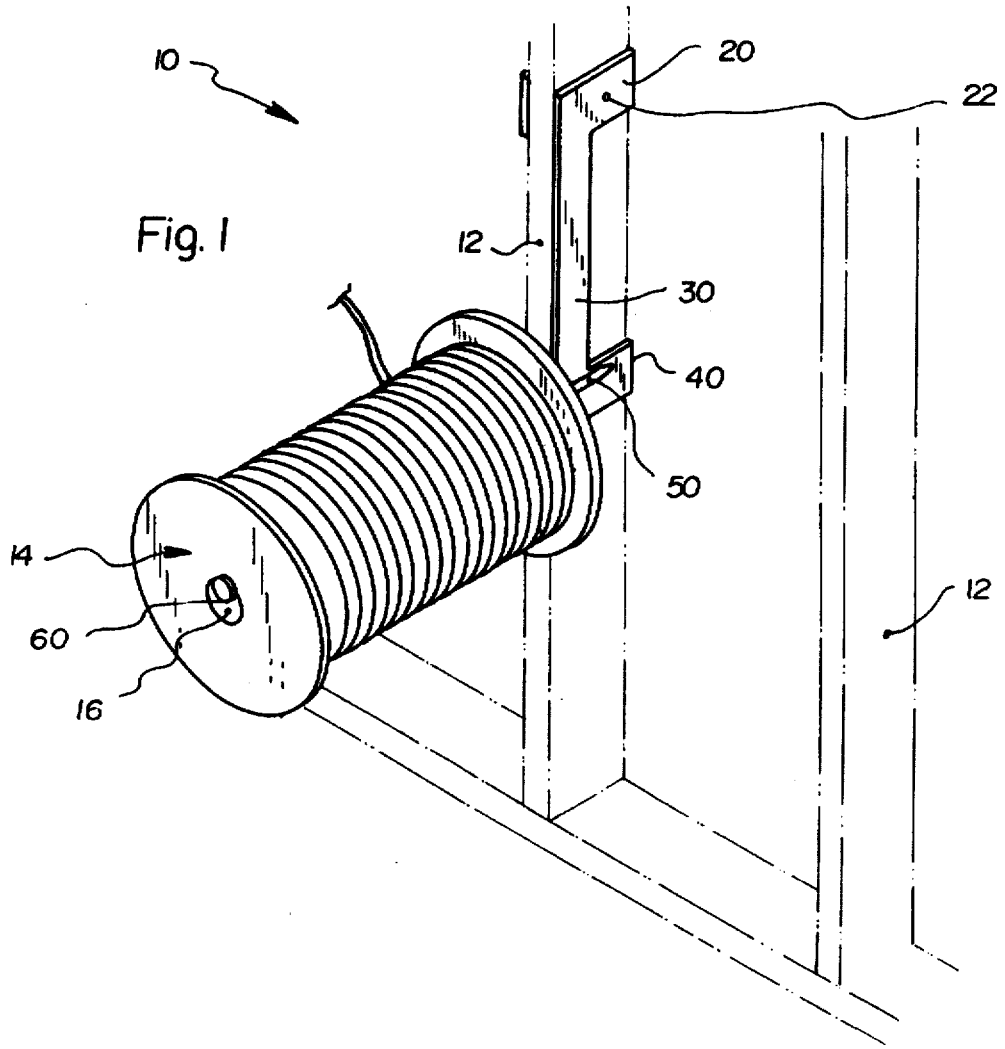
FIG. 1 is a perspective view of a new Stud Mounted Reel Support System according to the present invention.
Figure 2:
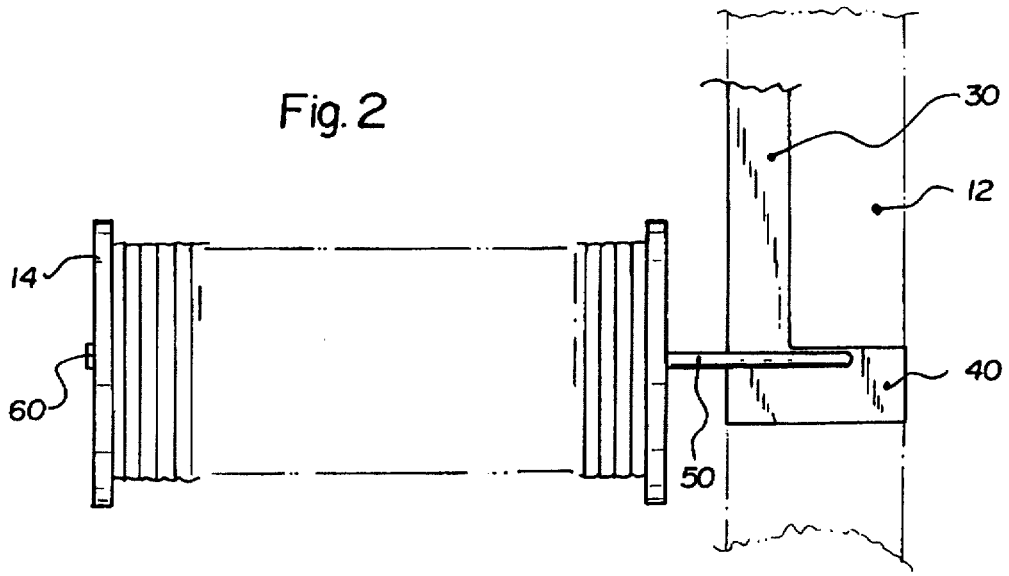
FIG. 2 is a side view thereof.
Figure 3:
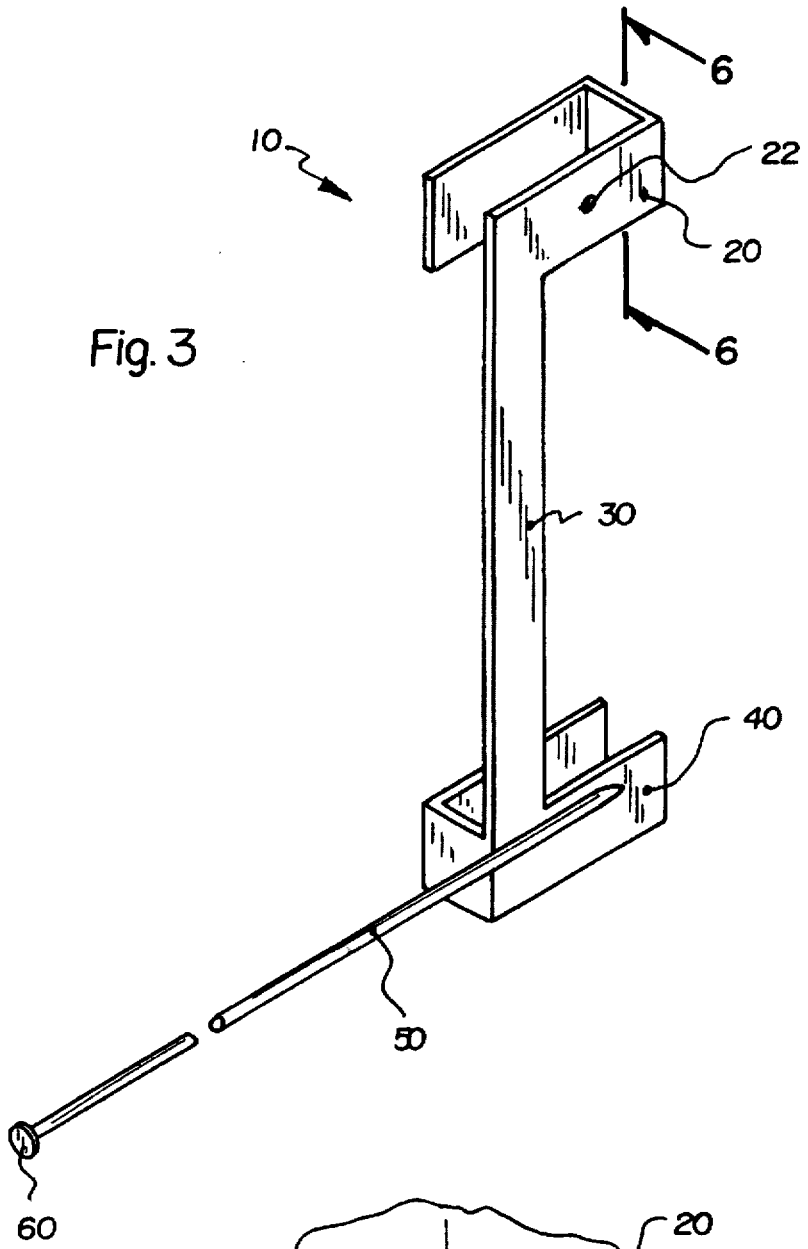
FIG. 3 is a perspective view of the present invention.
Figure 4:
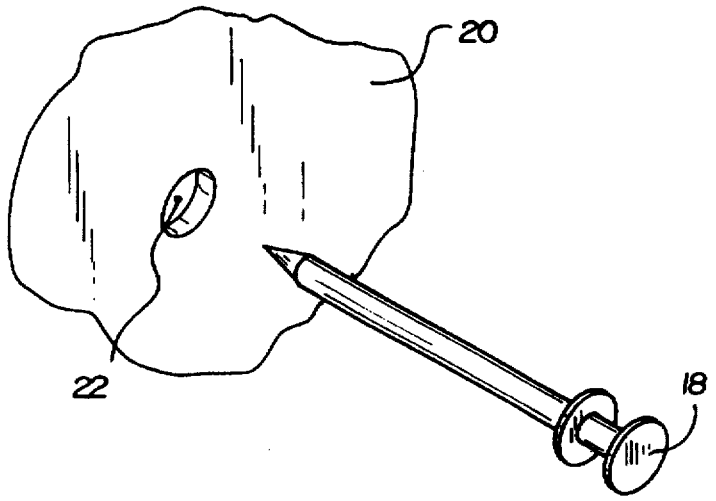
FIG. 4 is a magnified view of the upper cuff including an optional nail aperture.

With reference now to the drawings, and in particular to FIGS. 1 through 6 thereof, a new Stud Mounted Reel Support System embodying the principles and concepts of the present invention and generally designated by the reference numeral 10 will be described.

More specifically, it will be noted that the Stud Mounted Reel Support System 10 comprises an upper cuff 20 removably snugly positioned around the rear edge of a conventional stud 12, a connecting bar 30 secured at one end to the upper cuff 20, a lower cuff 40 removably snugly positioned around the front edge of the conventional stud 12 below the upper cuff 20, and secured to the end of the connecting bar 30 opposite of the upper cuff 20, and a horizontal cantilever arm 50 secured to the lower cuff 40 and projecting away from the conventional stud 12, whereby the horizontal cantilever arm 50 projects through a rotatably positioned wire reel 14 through the central reel passage 16 allowing the wire reel 14 to rotate.

Figure 6:
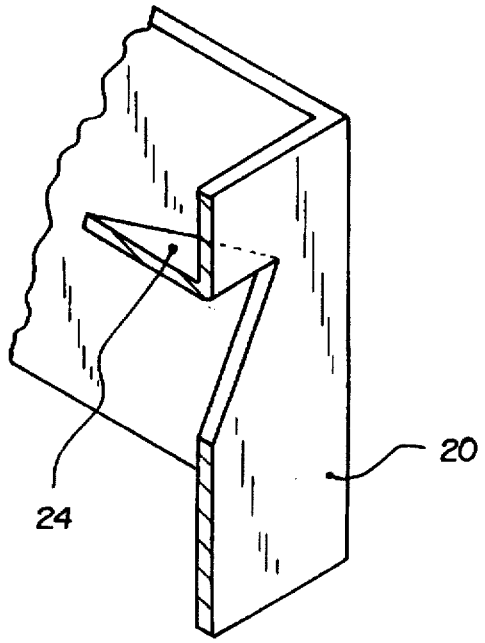
FIG. 6 is a cross sectional view taken along line 6—6 of FIG. 3 disclosing an optional semi-triangular spike.

As best illustrated in FIGS. 1 through 4, it can be shown that the horizontal cantilever arm 50 includes a flange 60 at the end opposite of the lower cuff 40 thereby retaining the wire reel 14 in position during rotation. The flange 60 is preferably removably screwed into the horizontal cantilever arm 50. As shown in FIG. 6 of the drawings, the upper cuff 20 preferably includes a semi-triangular spike 24 projecting horizontally from the rear portion into the pocket formed by the upper cuff 20. The semi-triangular spike 24 projects into the conventional stud 12. The upper cuff 20 includes at least one nail aperture 22 which receives a double headed nail 18 thereafter projecting into the conventional stud 12.

Figure 5:
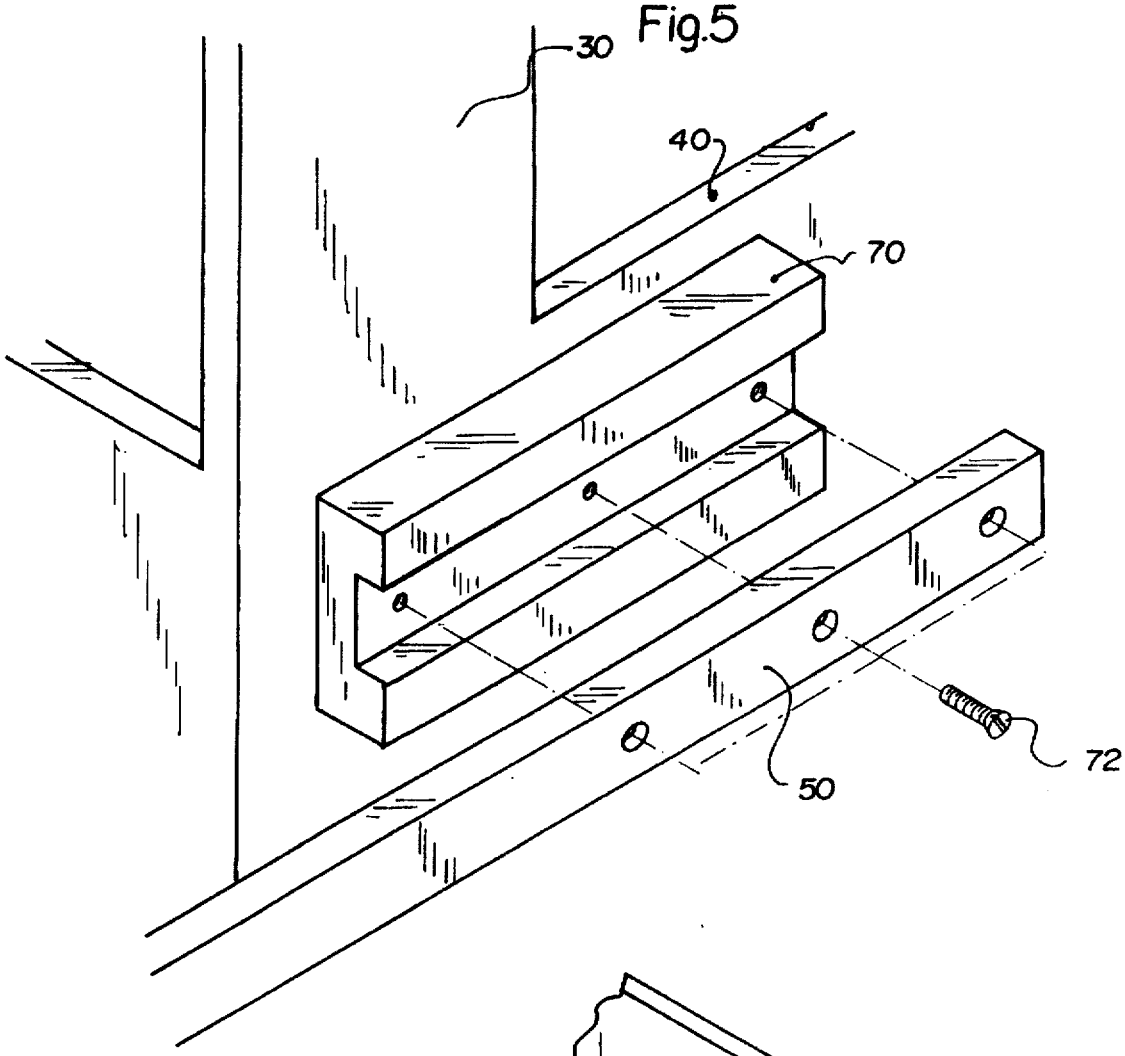
FIG. 5 is an alternative embodiment of the present invention disclosing a U-shaped bracket secured to the lower cuff and thereby receiving the horizontal cantilever arm.

In an alternative embodiment of the present invention as shown in FIG. 5 of the drawings, an upper cuff 20 is removably snugly positioned around the rear edge of a conventional stud 12, a connecting bar 30 is secured at one end to the upper cuff 20, a lower cuff 40 is removably snugly positioned around the front edge of the conventional stud 12 below the upper cuff 20, and secured to the end of the connecting bar 30 opposite of the upper cuff 20, a U-shaped bracket 70 is secured to the lower cuff 40, and a horizontal cantilever arm 50 is removably secured to the U-shaped bracket 70 by at least one counter sunk screw 72 and projecting away from the conventional stud 12. The horizontal cantilever arm 50 projects through a rotatably positioned wire reel 14 through the central reel passage 16 allowing the wire reel 14 to rotate. The horizontal cantilever arm 50 includes a flange 60 at the end opposite of the U-shaped bracket 70 thereby retaining the wire reel 14 in position during rotation. The flange 60 is removably screwed into the horizontal cantilever arm 50. The upper cuff 20 includes a semi-triangular spike 24 projecting horizontally from the rear portion into the pocket formed by the upper cuff 20. The semi-triangular spike 24 projects into the conventional stud 12. The upper cuff 20 includes at least one nail aperture 22 which receives a double headed nail 18 thereafter projecting into the conventional stud 12.

In use, the user positions the upper cuff 20 around the rear edge of the conventional stud 12. The user then positions the lower cuff 40 about the front edge of said conventional stud 12 below the upper cuff 20. The user then rotatably positions the wire reel 14 around the horizontal cantilever arm 50 which applies torque to the connecting bar 30 which presses the upper cuff 20 against the conventional stud 12 thereby gripping the conventional stud 12 and preventing the present invention from descending. Where a semi-triangular spike 24 exists, the user hammers the rear portion of the upper cuff 20 so as to force the semi-triangular spike 24 to penetrate the conventional stud 12. The user may also insert a double headed nail 18 through the nail aperture 22 into the conventional stud 12 for added gripping for an extremely heavy wire reel. The user then unwinds the required amount of wire from the wire reel 14. When a more convenient location for the present invention is desired, the user simply removes the present invention from around the conventional stud 12 and relocates the present invention to the new desired location and repeats the above stated procedure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Stud Mounted Reel Support System for removably mounting a dispensing reel on a vertically-oriented wall construction stud having first edge and a second edge, said dispensing reel being of the type having a central passage therein, said support system comprising:

an upper cuff for removably snugly mounting about the first edge of a wall construction stud;

a connecting bar secured at one end to the upper cuff;

a lower cuff for removably snugly mounting about the second edge of the wall construction stud below the position of the upper cuff, said lower cuff being secured to the end of the connecting bar opposite of the upper cuff; and a horizontal cantilever arm secured to the lower cuff for projecting away from the second edge of said stud such that inserting said cantilever arm through the center passage of a dispensing reel rotatably mounts said dispensing reel on said wall construction stud;

wherein the horizontal cantilever arm includes a flange at the end opposite of the lower cuff to retain the dispensing reel in position on said cantilever arm during rotation of said dispensing reel.

2. The Stud Mounted Reel Support System of claim 1 wherein the flange is removably screwed into the horizontal cantilever arm.

3. The Stud Mounted Reel Support System of claim 1, wherein the upper cuff comprises a U-shaped structure defining a stud space for receiving a wall construction stud, and wherein the upper cuff includes a semi-triangular spike projecting horizontally from the U-shaped structure of the upper cuff into the stud space such that the semi-triangular spike projects into a wall construction stud positioned in said stud space.

4. The Stud Mounted Reel Support System of claim 1, wherein the upper cuff includes at least one nail aperture for receiving therethrough a nail driven into a wall construction stud on which the upper cuff is mounted.

5. A Stud Mounted Reel Support System for removably mounting a dispensing reel on a vertically-oriented wall construction stud having a first edge and a second edge, said dispensing reel being of the type having a central passage therein, said support system comprising:

an upper cuff for removably snugly mounting about the first edge of a wall construction stud;

a connecting bar secured at one end to the upper cuff;

a lower cuff for removably snugly mounting about the second edge of the wall construction stud below the position of the upper cuff, said lower cuff being secured to the end of the connecting bar opposite of the upper cuff;

a channel bracket secured to the lower cuff; and a horizontal cantilever arm removably secured to the channel bracket by at least one screw for projecting away from the the second edge of said stud such that inserting said cantilever arm through the center passage of a dispenser reel rotatably mounts said dispenser reel on said wall construction stud.

6. The Stud Mounted Reel Support System of claim 5, wherein the horizontal cantilever arm includes a flange at the end opposite of the U-shaped bracket to retain the dispensing reel in position on said cantilever arm during rotation of said dispensing arm.

7. The Stud Mounted Reel Support System of claim 6 wherein the flange is removably screwed into the horizontal cantilever arm.

8. The Stud Mounted Reel Support System of claim 5 wherein the upper cuff comprises a U-shaped structure defining a stud space for receiving a wall construction stud, and wherein the upper cuff includes a semi-triangular spike projecting horizontally from the U-shaped structure of the upper cuff into the stud space such that the semi-triangular spike projects into a wall construction stud positioned in said stud space.

9. The Stud Mounted Reel Support System of claim 5 wherein the upper cuff includes at least one nail aperture for receiving therethrough a nail driven into a wall construction stud on which the upper cuff is mounted.

* * * * *